US005781096A

United States Patent [19]

Yasukuni et al.

[11] Patent Number: 5,781,096

[45] Date of Patent: Jul. 14, 1998

[54] PLANAR FUSE AND METHOD FOR MAKING THE SAME

[75] Inventors: Jun Yasukuni; Hidemi Tanigawa; Yutaka Furuno, all of Yokkaichi, Japan

[73] Assignee: Sumitomo Wiring Systems, Ltd., Japan

[21] Appl. No.: 759,530

[22] Filed: Dec. 4, 1996

[30] Foreign Application Priority Data

Dec. 5, 1995 [JP] Japan ..... 7-344959

[51] Int. Cl.[6] ..... H01H 85/12

[52] U.S. Cl. ..... 337/297; 337/161; 337/227; 337/229

[58] Field of Search ..... 337/297, 161, 337/181, 227, 229, 230, 256, 283; 361/833

[56] References Cited

U.S. PATENT DOCUMENTS

| | | | |
|---|---|---|---|
| 4,149,137 | 4/1979 | Konnemann . | |
| 4,214,223 | 7/1980 | Kourimsky . | |
| 4,520,338 | 5/1985 | Watanabe . | |
| 4,680,568 | 7/1987 | Mark et al. | 337/186 |
| 4,706,059 | 11/1987 | Fritz | 337/297 |

FOREIGN PATENT DOCUMENTS

| | | |
|---|---|---|
| 0000164 | 1/1979 | European Pat. Off. . |
| 2358008 | 2/1978 | France . |
| 2397058 | 2/1979 | France . |
| 2530074 | 1/1984 | France . |
| 130288 | 5/1988 | Germany . |
| 52-86148 | 7/1977 | Japan . |
| 56-38959 | of 1981 | Japan . |
| 61-14625 | 4/1986 | Japan . |

*Primary Examiner*—Leo P. Picard
*Assistant Examiner*—Anatoly Vortman
*Attorney, Agent, or Firm*—Jordan B. Bierman; Bierman, Muserlian and Lucas

[57] ABSTRACT

Separating walls are formed between adjacent grooves on the surface of a base. Circuits including fusible strips are mounted in the grooves. Thereafter, the separating walls are crushed so that they overlie the strips, retain them in the grooves, and protect them against foreign particles. Thus, if such a particle manages to impact a strip, no short-circuit will result, even if the strip should begin to peel.

8 Claims, 8 Drawing Sheets

PLANAR FUSE AND METHOD FOR MAKING THE SAME

This application claims the priority of Japanese Application 7/344,959, filed Dec. 5, 1995.

The present Invention relates to a planar fuse in which a fusing path having a prescribed conductive capacity is disposed on the surface of an insulative base. The present Invention also relates to a method for making the fuse.

BACKGROUND OF THE INVENTION

Referring to FIG. 11 and FIG. 12, a similar type of planar fuse has been proposed in Japanese Utility Model Laid-Open Publication 56-38959. In the fuse disclosed in this Publication, the fusing path is circuit 2 formed of a thin metallic film adhered to the surface of insulative base 1 by etching and vaporization.

In this configuration, electricity passes through circuit 2 on the surface of insulating base 1; when the prescribed electrical capacity is exceeded, the thin film heats up and melts, thereby breaking the circuit.

In FIG. 13, a blade-shaped fuse is shown. While not planar, it is similar to the foregoing fuse. A shape is molded to form two thick plates 3,3 serving as terminals, and string-shaped fusing path 4 connects the two thick plates. Resin 5 covers the outside.

The prior art fuses described above have a number of problems. When a plurality of such fuses is arranged to provide circuits, foreign particles can impact on the fuse causing it to peel away, thus creating the possibility of a short-circuit with a neighboring fuse. Also, since the circuit is formed by etching and vaporization, wet production is necessary, thus requiring a difficult operating environment.

With the blade-shaped fuses, it is necessary to keep the plates thick since they must also serve as terminals. Extra cutting or stamping is required in order to leave a thin, wire-shaped fusing path, and this increases production costs. Also, because of the thickness of the base, the large cross-section makes it difficult to provide a fuse for low capacities; similarly, using the fuse for multiple electrodes is also difficult.

SUMMARY OF THE INVENTION

The object of the present Invention is to overcome the problems of the prior art described above. A further object of the present Invention is to provide a planar fuse which prevents short circuits between adjacent conductors, does not require wet processes in manufacturing, and is easy to manufacture.

In the present Invention, fusing paths are arranged in parallel rows on the insulative base, with a separation between each path. Thus, if a foreign particle impacts a path, it may peel off, but it will not go past the separation to come into contact with an adjacent fusing path. The paths have a predetermined capacity and are mounted between projections formed on the surface of the insulative base.

In one form of the Invention, pressure is exerted on the projections so that they spread and bear against the edges of the fusing paths, thereby retaining them on the base. In a modification of the Invention, only parts of the fusing path are overlain by the spread portions.

Thus, the portion that is to come into contact with external electrodes and the like has a large exposed area, and the portion that will not come into contact has little or no exposed area. The large exposure area at the uncovered portion enhances the ability to act as contact surfaces for electrodes and the like, while the little or no exposure areas protect the fuse from foreign particles. Preferably, the surfaces of the projections slope upward toward the edges of the fusing paths. When the projections are pressed flat, they bear against the fusing paths and the under surfaces of the projections cover at least the edges thereof.

In another modification of the Invention, the fusing path passes over a cavity in the base and is suspended in mid-air. This prevents heat generated in the fusing path from being dissipated into the insulative base. Thus, the heat from the portion of the fusing path that is suspended in mid-air is not absorbed, allowing heat build-up and fusing as desired.

In a further embodiment of the Invention, the base is folded so that the fusing path on its surface forms a circuit from one side of the base to the other. The fusing paths can be placed in prescribed circuits by inserting the edge of the base at the fold line into a socket comprising terminals that come into contact therewith on both sides of the base. The present Invention, as described above, provides a planar fuse that prevents fusing paths from short-circuiting since adjacent paths are isolated from each other by separating walls.

Thus, the need for wet processes such as etching, vaporizing, and gluing, is eliminated, and significant improvements in efficiency of production are achieved.

BRIEF DESCRIPTION OF THE DRAWINGS

In the accompanying drawings, constituting a part hereof, and in which like reference characters indicate like parts.

DETAILED DESCRIPTION OF THE INVENTION

Figure 1:
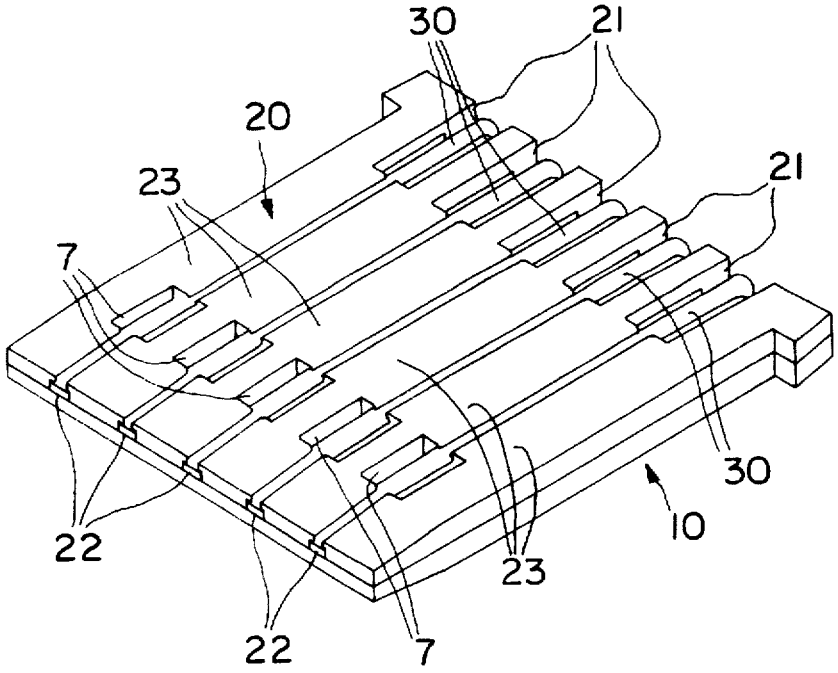
FIG. 1 is a perspective view of the fuse according to the present Invention.
Figure 2:
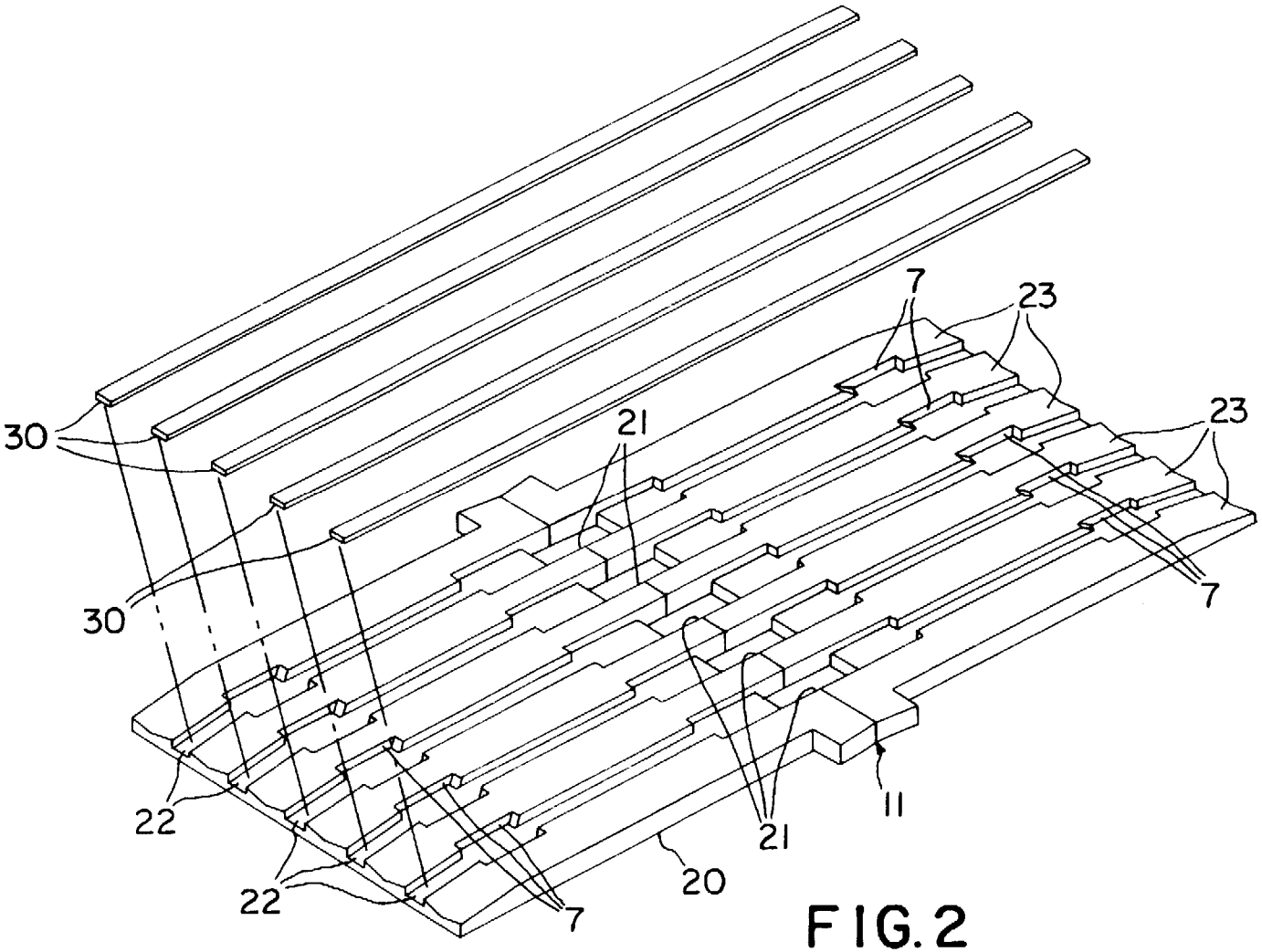
FIG. 2 is an exploded view of the fuse of FIG. 1 before folding and insertion of the fusible strips.

Referring to FIGS. 1 and 2, five circuits are arranged in parallel on the surface of insulative base 20 to form planar fuse 10. Fusible strips 30 are in grooves 22 and are folded back at a point midway between their ends. Windows 21 are formed toward the center of base 20 where it intersects the circuits. Each strip 30 is suspended in mid-air at window 21, has a predetermined electrical capacity depending on its cross-section, and is designed so that it fuses when the electric current flow exceeds this capacity. Thus, the circuits serve as fusing paths.

Insulative base 20 is bent in two at fold line 11 in a manner resembling two hands held together in prayer. However, base 20 does not need to be bent over, and can be flat as long as the circuits can be arranged on the surface. Also, it is not absolutely necessary to have windows 21. However, by arranging the circuits to intersect windows 21, fusible strips 30 can be suspended mid-air. This prevents the heat generated in strips 30 from being absorbed by base 20, thereby allowing the suspended portion to melt more easily and more accurately. For this reason, windows 21 are cavities. Of course, windows 21 do not need to be continuous; it is sufficient if they are cavities which allow strips 30 to be out of contact with base 20 at one point.

Furthermore, strips 30 need not have a planar cross-section; the shape can be e.g. circular or trapezoidal in cross-section, as long as they can be affixed to the base. On base 20, grooves 22 correspond to the location of strips 30. Separating walls 23 are on either side of each groove 22.

Figure 3:
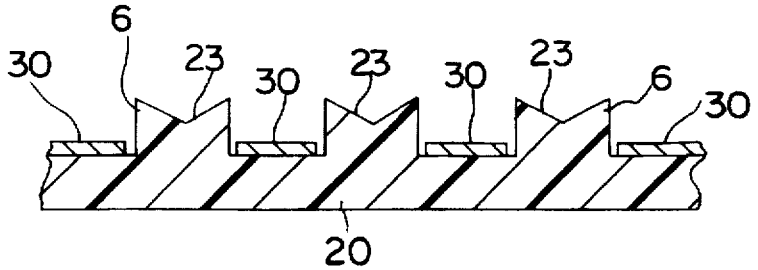
FIG. 3 is a partial cross-section of one form of the fuse before pressing.
Figure 4:
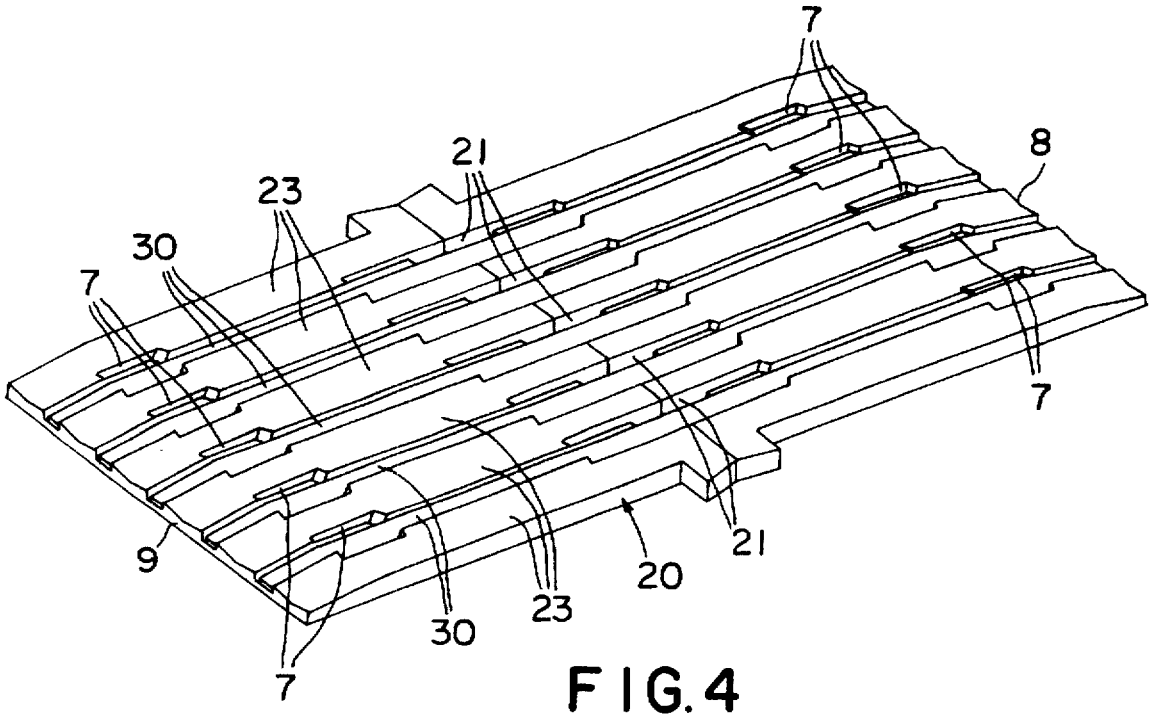
FIG. 4 is a perspective of the fuse of FIG. 3 before pressing.
Figure 5:
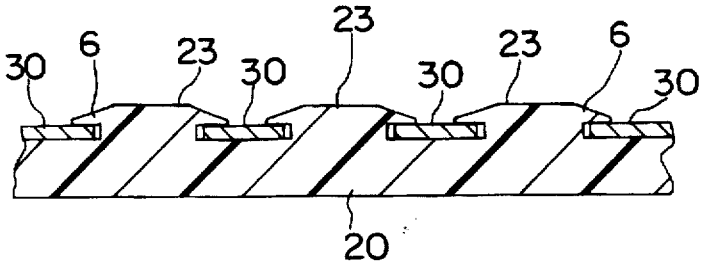
FIG. 5 is a partial cross-section of the fuse of FIG. 3 after pressing.
Figure 6:
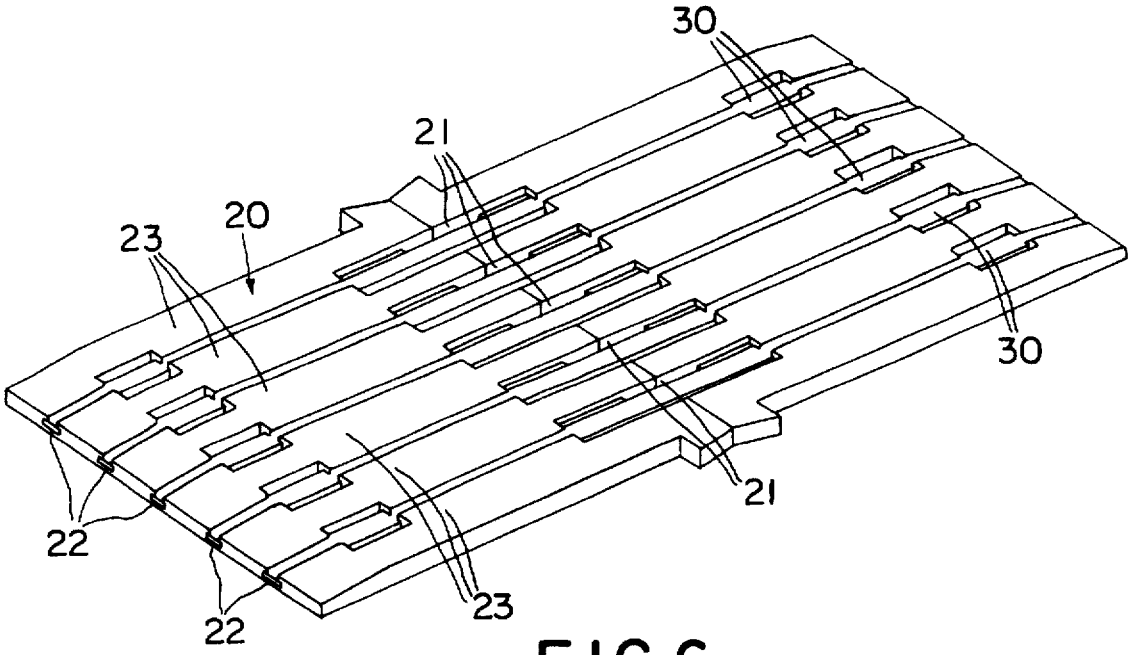
FIG. 6 is a perspective of the fuse of FIG. 3 after pressing.

Referring to FIGS. 3 and 4, the surface of separating wall 23 is sloped so that the ends adjacent groove 22 project upward. Strips 30 are mounted in grooves 22 and projecting portions 6 are pressed downward. As can be seen in FIGS. 5 and 6, the pressed portions bear against and retain the edges of strips 30.

Figure 7:
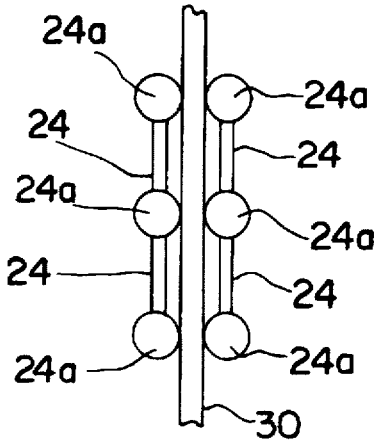
FIG. 7 is a plan view of the fuse with an alternative form of the projection before pressing.
Figure 8:
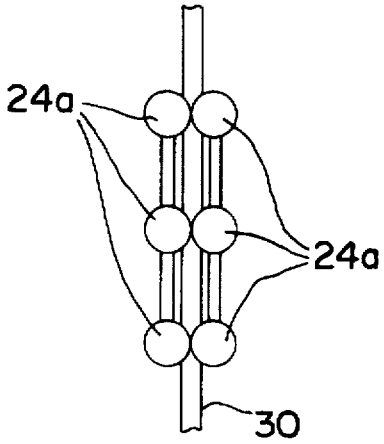
FIG. 8 is a plan view of the fuse of FIG. 7 after pressing.
Figure 9:
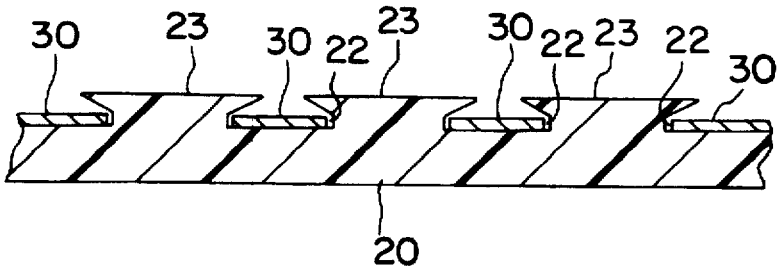
FIG. 9 is a partial cross-section of the fuse showing an alternative form of the projections.

In this embodiment, the entire surface of separating wall 23 is pressed. However, separating walls 23 need only cover and apply pressure to the edges of adjacent strips 30. Therefore, it is possible to form projections 24*a* at various points on separating wall 24, as shown in FIG. 7. Projections 24*a* are then pressed to provide localized pressure on—and retention of—strips 30. Of course, the cross-section of the projection does not need to have the particular sloped form described above. In FIG. 9, the surface of separating wall 23 is flat throughout and still prevents the edges of strips 30 from rising out of groove 22. In terms of strength, the embodiment of FIG. 5 is stronger, but the flat structure shown in FIG. 9 can be used as well, depending on the amount of strength required.

Separating wall 23 need not be formed uniformly on base 20. At the portions near the ends of the base, separating walls 23 are spaced apart from groove 22. As shown in FIG. 6, when pressure is exerted on the base, thereby crushing separating walls 23, the walls in this region are not pushed into groove 22 and do not overlie the edges of strips 30.

Figure 10:
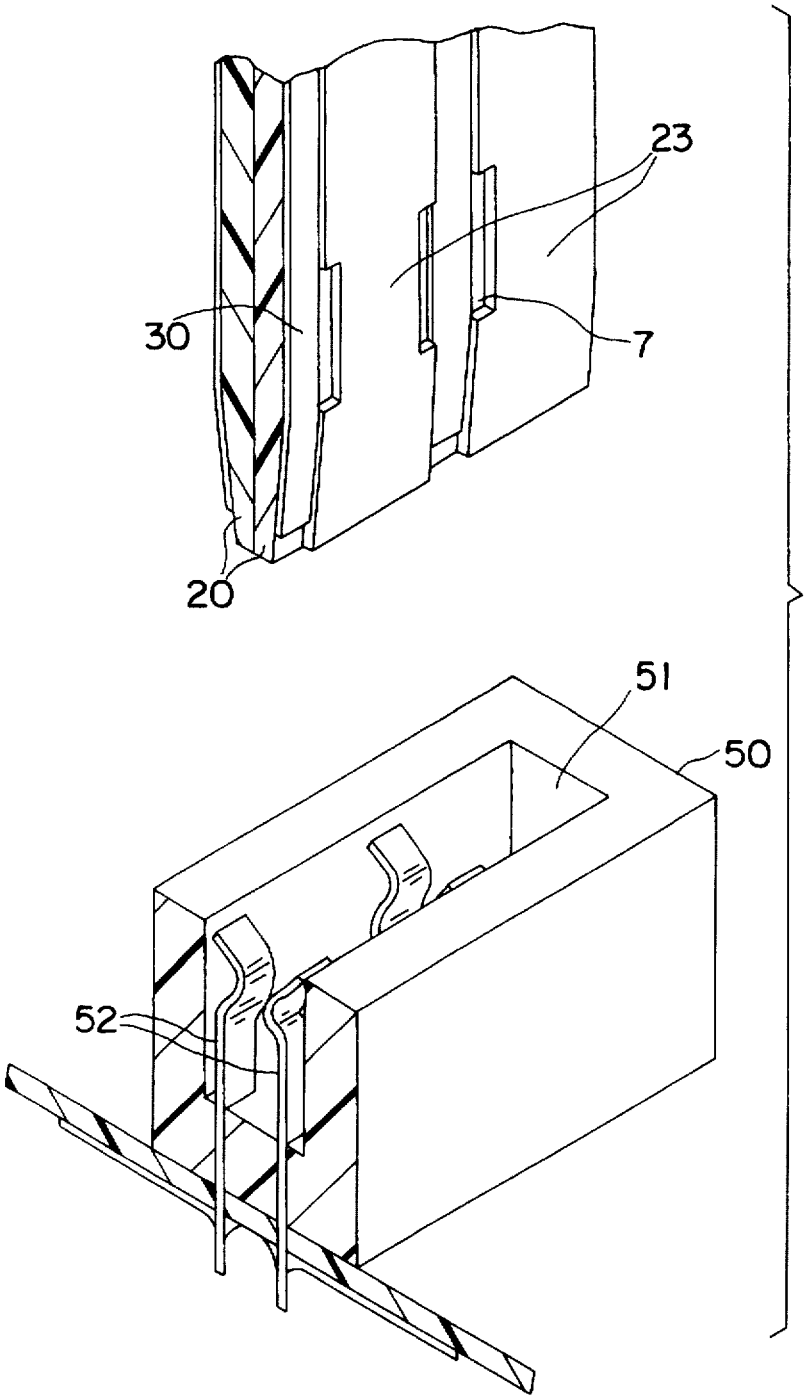
FIG. 10 is a partial cross section in perspective showing the mounting of the fuse in a socket.
Figure 11:
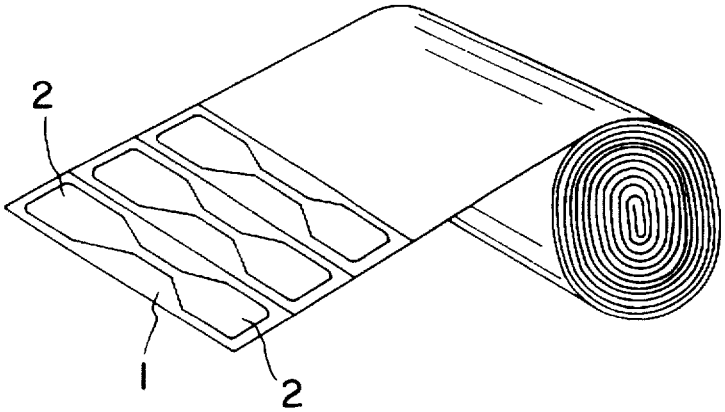
FIG. 11 PRIOR ART
FIG. 11 is a perspective of a prior art fuse before folding.
Figure 12:
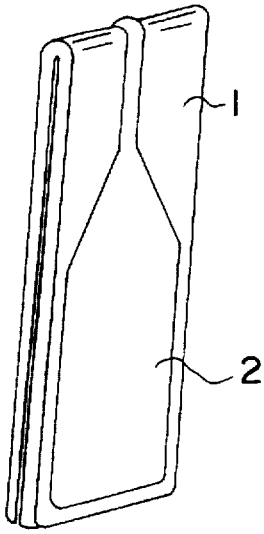
FIG. 12 PRIOR ART
FIG. 12 is a perspective of the prior art fuse of FIG. 11 after folding.
Figure 13:
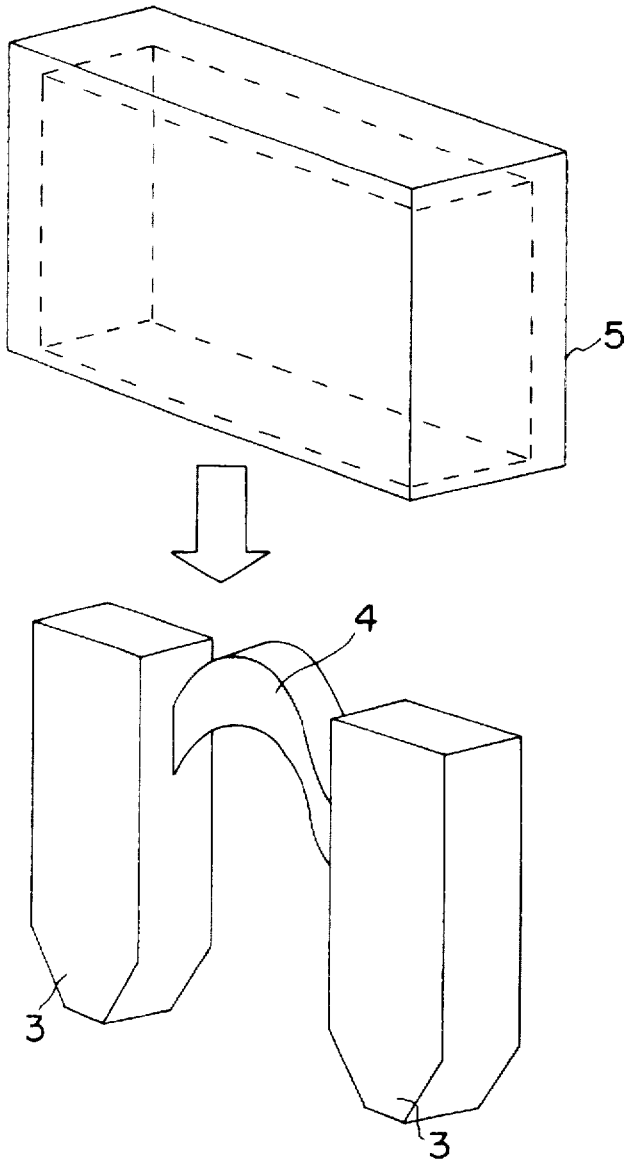
FIG. 13 PRIOR ART
FIG. 13 is a perspective of a prior art blade-shaped fuse.

Referring to FIG. 10, the fuse is inserted into socket 50 through slit 51. Metal terminals 52, 52 are supported by slit 51 so that they face each other and are adapted to contact the surfaces of strips 30 at windows 7. This provides a wide area of contact, insuring that good electrical connection will result; at the same time, for protection, the other portions are exposed only slightly. After wall 23 is crushed, base 20 is bent in two at fold line 11 to complete fuse 10.

To produce the fuse of the present Invention, fusible strip 30 is mounted in groove 22 in base 20. Retaining projections 6 on wall 23 adjacent grooves 22 are crushed as by high-frequency welding, heating, or high-frequency heating, and the edges of strips 30 are held and retained thereby. Thus, it is not necessary to perform any wet production processes such as etching, vaporization, or gluing, thereby making production very efficient. It is also possible to form a bend beforehand, and fix the parts through heating. Fixing can be performed without heating by forming interlocking cavities and projections to facilitate engagement, and then joining the parts.

If a foreign particle impacts on the surface of assembled fuse 10, it is difficult for it to affect strips 30. At the most, only a very small area of the strips is exposed; separating wall 23 seals and protects them. However, even if a particle does get through and cause strip 30 to begin to peel off, short-circuiting is prevented by the presence of separating wall 23 between adjacent circuits. In introducing fuse 10 into an electric circuit, if socket 50 is mounted as shown in FIG. 10, strips 30 are substantially exposed only where separating wall 23 is not crushed downward, i.e. at windows 7, thus allowing terminals 52, 52 to form good electrical contacts with strips 30.

In summary, wall 23 is formed between adjacent grooves 22 on the surface of base 20 and circuits comprising fusible strips 30 are mounted therein. By crushing separating wall 23, strips 30 are pressed down and retained. If a foreign particle impacts fuse 10, it will not short-circuit with an adjacent strip 30 even if it starts to peel off.

Although only a specific number of embodiments of the present Invention have been expressly disclosed, it is, nonetheless, to be broadly construed and not to be limited except by the character of the claims appended hereto.

What we claim is:

1. A planar fuse comprising an insulative base (20) having a plurality of parallel grooves (22) spaced apart laterally from each other, said grooves (22) extending from a front edge (8) to a rear edge (9), a fusible strip (30) in each said groove (22), a retaining projection (6) on said insulative base (20) adjacent one of said grooves (22), said retaining projection overlying at least a part of said fusible strip (30), thereby securing said strip (30) in said groove (22).

2. The planar fuse of claim 1 wherein said strip (30) has a predetermined electric current carrying capacity, said strips (30) adapted to fuse when said capacity is exceeded.

3. The planar fuse of claim 1 wherein said insulative base (20) comprises a cavity beneath a portion of said fusible strip (30).

4. The planar fuse of claim 1 wherein said insulative base (20) comprises a fold line between said front edge (8) and said rear edge (9), said fuse being folded along said fold line so that said front edge (8) is adjacent said rear edge (9).

5. The planar fuse of claim 1 wherein portions of said grooves (22) are wider than remaining portions of said grooves, thereby creating windows (7) which facilitate contact between said fusible strips and another electrical device.

6. The planar fuse of claim 1 wherein said insulative base (20) has a thickness which reduces from points spaced apart from said front edge (8) and said rear edge (9) toward said front edge (8) and said rear edge (9), respectively.

7. A method for the manufacture of a planar fuse comprising an insulative base (20) having a plurality of parallel grooves (22) spaced apart laterally from each other, said grooves (22) extending from a front edge (8) to a rear edge (9), a retaining projection (6) adjacent one of said grooves (22), said method comprising placing a fusible strip (30) in one of said grooves, exerting pressure on said retaining projection, thereby causing it to overlie at least a portion of said strip and secure said strip in said groove.

8. The method of claim 7 wherein said retaining projection (6) prior to pressure being exerted thereon, has a surface which slopes upwardly toward said groove (22).

* * * * *